US006676237B2

(12) United States Patent
Kobayashi et al.

(10) Patent No.: US 6,676,237 B2
(45) Date of Patent: Jan. 13, 2004

(54) INK JET RECORDING APPARATUS AND METHOD OF CORRECTING CALCULATION OF INK AMOUNT CONSUMED THEREIN

(75) Inventors: Atsushi Kobayashi, Nagano (JP); Toshio Kumagai, Nagano (JP); Seiji Mochizuki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 61 days.

(21) Appl. No.: 10/040,918

(22) Filed: Jan. 9, 2002

(65) Prior Publication Data

US 2002/0089555 A1 Jul. 11, 2002

(30) Foreign Application Priority Data

Jan. 9, 2001 (JP) ..... 2001-001001
Dec. 13, 2001 (JP) ..... 2001-379678

(51) Int. Cl.[7] ..... B41J 2/175; B41J 2/195
(52) U.S. Cl. ..... 347/7
(58) Field of Search ..... 347/7, 85

(56) References Cited

U.S. PATENT DOCUMENTS 5,132,711 A * 7/1992 Shinada et al. ..... 347/7
5,136,309 A * 8/1992 Iida et al. ..... 347/7
5,616,929 A * 4/1997 Hara ..... 250/573
5,712,667 A * 1/1998 Sato ..... 347/7
5,956,057 A 9/1999 Childers et al.
6,155,664 A * 12/2000 Cook ..... 347/7
6,334,658 B1 * 1/2002 Suzuki ..... 347/7
6,435,638 B1 * 8/2002 Wilson et al. ..... 347/7
6,456,802 B1 * 9/2002 Phillips ..... 399/27

FOREIGN PATENT DOCUMENTS

| | | |
|---|---|---|
| EP | 0 956 964 A2 | 11/1999 |
| EP | 1 052 100 A2 | 11/2000 |
| JP | 60172546 | 9/1985 |
| JP | 62152859 | 7/1987 |
| JP | 2000108371 | 4/2000 |
| JP | 2000218823 | 8/2000 |

* cited by examiner

*Primary Examiner*—Stephen D. Meier
*Assistant Examiner*—Blaine Mouttet
(74) *Attorney, Agent, or Firm*—Sughrue Mion, PLLC

(57) ABSTRACT

An ink cartridge for supplying ink to a recording head is detachably mounted on a cartridge holder. A calculator performs calculation of an ink amount consumed by the recording head. A counter updates a residual ink amount in the mounted ink cartridge based on the consumed ink amount calculated by the calculator. A monitor monitors an ink amount contained in the mounted ink cartridge to judge at least an ink-end state in which the ink amount in the ink cartridge is a predetermined amount or less. A corrector corrects the way of calculation in the calculator based on the residual ink amount indicated by the counter, when the monitor judges that the mounted ink cartridge is in the ink-end state.

21 Claims, 11 Drawing Sheets

INK JET RECORDING APPARATUS AND METHOD OF CORRECTING CALCULATION OF INK AMOUNT CONSUMED THEREIN

BACKGROUND OF THE INVENTION

The present invention relates to an ink jet recording apparatus, and a method of correcting calculation of a consumed amount of ink which is supplied from an ink cartridge loaded in the recording apparatus in order to exactly grasp a residual ink amount in the ink cartridge.

For example, in an ink jet recording apparatus provided for office or business use, an ink cartridge of large capacity must be used for dealing with a relatively large amount of printing. To cope with this, the ink cartridges of different color inks are loaded to a cartridge holder installed to the apparatus body. Subtanks are mounted on a carriage with a recording head mounted thereon. Ink is supplied from each ink cartridge to the associated subtank via an ink replenishing tube, and then is supplied to the recording head, from the subtank.

The ink cartridge used by the recording apparatus thus constructed is provided with an ink-end determinant for verifying as to whether or not each ink cartridge is in an ink-end state. An ink-end determinant is proposed which counts up the number of ink drops ejected from the recording head in accordance with print data and the number of ink drops ejected from the recording head based on a flushing operation, converts the count value into a consumed ink amount, and estimates an ink-end state based on the converted one.

In the ink-end determinant, the numbers of ink drops ejected are converted into the consumed ink amount. Accordingly, the converted values of the consumed ink amount are varied among the different recording apparatus. Usually, it is unavoidable that the weight value of the ink drop is varied by ±10% among the different recording apparatus. Accordingly, if the variation is shifted to an ink empty state, the machine judges that the ink cartridge is in an ink-end state, though the use recognizes that ink is still left in the ink cartridge. Such a situation should be avoided.

To avoid this, the weight of the ink drop is set based on a large weight of the ink drop within the variation of the weight values. Where the weight is so set, if the variation of weight value of the ink drop is shifted to the minimum weight, the machine will judge that the ink cartridge is in an ink-end state in a state that ink having an amount of 20% of the total ink capacity is left in the cartridge. Accordingly, the running cost is increased for the user. Since a relative large amount of ink is left in the used ink cartridge, a problem of disposing the residual ink in the ink cartridge additionally arises.

In recent years, with diversification of printing, the pigment-dispersed type ink tends to be employed. In this kind of ink, pigment precipitates into the solvent, so that a concentration of the residual ink is high. In this respect, there is a technical requirement of issuing an ink end sign immediately before the ink is used up in the ink cartridge. To meet such a requirement, the ink end must be judged highly accurately so as to leave a minimum amount of ink in the ink cartridge.

SUMMARY OF THE INVENTION

It is therefore an object of the present invention is to provide an ink jet recording apparatus which can judge an ink-end state with high accuracy by correcting calculation of a consumed ink amount in accordance with the individual difference of the recording apparatus, and a correction method which can attain the above.

In order to achieve the above object, according to the present invention, there is provided an ink jet recording apparatus, comprising:

- a recording head, from which ink drops are ejected;
- a cartridge holder, on which an ink cartridge for supplying ink to the recording head is detachably mounted;
- a calculator, which performs calculation of an ink amount consumed by the recording head;
- a first counter, which updates a residual ink amount in the mounted ink cartridge based on the consumed ink amount calculated by the calculator;
- a monitor, which monitors an ink amount contained in the mounted ink cartridge to judge at least an ink-end state in which the ink amount in the ink cartridge is a predetermined amount or less; and
- a corrector, which corrects the calculation in the calculator based on the residual ink amount indicated by the first counter, when the monitor judges that the mounted ink cartridge is in the ink-end state.

Preferably, the calculator multiplies a coefficient by the number of ink drops ejected from the recording head at least when a printing operation is performed and when a flushing operation is performed.

Here, it is preferable that the corrector corrects the coefficient. Further, it is preferable that the coefficient is managed in accordance with a weight of each ink drop.

Still further, it is preferable that the calculator performs the calculation every time when a cleaning operation of the recording head is performed.

Preferably, the ink jet recording apparatus further comprises a subtank, which stores ink replenished from the ink cartridge and supplies the ink to the recording head. Here, the monitor judges the ink-end state when a predetermined amount of ink is not replenished from the ink cartridge to the subtank, even though a predetermined time period has elapsed since the ink replenishment is started.

Here, the ink cartridge and the subtank are connected via a replenishing passage provided with a valve. The subtank includes a detector which detects an ink amount contained in the subtank. The valve is opened when the consumed ink amount calculated by the calculator reaches a predetermined value. The valve is closed when the detector detects an ink-full state in which the ink replenished in the subtank reaches a predetermined amount.

Further, it is preferable that the detector includes a float member which floats on the ink contained in the subtank, and a signal generator which generates an electric signal varied in accordance with a position of the float member in the subtank.

Here, it is preferable that the monitor includes a timer which starts clocking when the valve is opened. The monitor judges the ink-end state when the ink-full state is not detected by the detector even though the timer clocks a predetermined time period.

Preferably, the ink-end state judged by the monitor is effected only when the updated residual ink amount of the first counter is a predetermined value or less. Here, the monitor refers to the residual ink amount indicated by the first counter when the apparatus is activated, when the ink cartridge is replaced, and when a printing operation is paused to feed a next recording sheet. Here, operations of the recording apparatus is stopped when the monitor judges the ink-end state.

Preferably, the ink jet recording apparatus further comprises an air compressor. Here, the ink cartridge includes an air-tight casing, a flexible ink pack containing ink therein, which is accommodated within the casing. Air compressed by the air compressor is applied to a space defined between the casing and the ink pack so that the ink pack is contracted in accordance with the ink replenishment to the subtank.

Here, it is preferable that the monitor includes a plate member provided on the ink pack and a switch member which is operated by the plate member in accordance with the contraction of the ink pack.

Alternatively, it is preferable that the monitor includes a transparent part formed on at least a lower portion of the ink cartridge, at least one pair of a light source and a photo sensor, which are opposed to each other through the transparent part. Here, the monitor judges the ink-end state when an ink level in the ink cartridge lowers an optical path ranging from the light source to the photo sensor.

Alternatively, it is preferable that the monitor includes a prism member formed on at least a lower part of the ink cartridge. The monitor judges the ink-end state based on a difference between a first critical angle of total reflection defined by refractive indices of the ink in the ink cartridge and a material of the prism member, and a second critical angle of total reflection defined by refractive indices of the material of the prism member and atmosphere. Here, the monitor includes at least one pair of a light source which emits a light beam toward the prism member and a photo sensor which detects the light beam reflected by the prism member. The monitor judges the ink-end state when the photo sensor detects the light beam reflected by the prism member.

Alternatively, it is preferable that the monitor includes at least one pair of electrode terminals provided in at least a lower portion of the ink cartridge while extending inside of the ink cartridge and a detection circuit which detects a resistance between the electrode terminals. Here, the monitor judges the ink-end state when the detection circuit detects a drop of the resistance.

Preferably, the ink jet recording apparatus further comprises:

- a subtank, which stores ink replenished from the ink cartridge and supplies the ink to the recording head;
- a detector, which detects an ink amount contained in the subtank;
- a second counter, which updates an ink amount consumed by the recording head based on the consumed ink amount calculated by the calculator,
- wherein the corrector corrects the calculation in the calculator based on the consumed ink amount indicated by the second counter, when the detector detects that the ink amount in the subtank is a predetermined amount or less.

According to the present invention, there is also provided a method of correcting calculation for an ink amount consumed in a recording head incorporated in an ink jet recording apparatus, the step comprising the steps of:

- providing an ink tank which supplies ink to the recording head;
- providing a counter which indicates a residual ink amount in the ink tank;
- calculating an ink amount consumed by the recording head;
- updating the residual ink amount indicated by the counter, based on the calculated consumed ink amount;
- monitoring a residual ink amount in the ink tank independently from the counter; and
- correcting the way of calculation, based on the updated residual ink amount of the counter, when the monitored residual ink amount is predetermined amount or less.

Here, it is preferable that the calculation is performed by multiplying a coefficient by the number of ink drops ejected from the recording head at least when a printing operation is performed and when a flushing operation is performed. The coefficient is corrected in the correcting step.

According to the above configurations, when the monitor judges that the ink cartridge is in the ink-end state, a count value of the first counter is referred to. The way of calculation in the calculator is corrected according to the referred count value of the first counter.

When the referred count value of the first counter indicates that the residual ink amount is larger than a predetermined amount, the coefficient to be multiplied by the number of ink drops ejected from the recording head is corrected to be large, viz., the weight of the ink drop is corrected to be large. As a result, a counting rate of the calculating value in the consumed ink amount calculator is increased.

When the referred count value of the first counter indicates that the residual ink amount is smaller than the predetermined value, the correction process is performed in the contrary manner to that in the above case. As a result, a counting rate of the calculating value in the consumed ink amount calculator is decreased.

If the coefficient correcting process is repeatedly executed for several times of the replacement of the ink cartridge, the judging accuracy may be improved. With this, variations of the judging results of the different recording apparatus are made small.

According to the present invention, there is also provided an ink jet recording apparatus, comprising:

- a recording head, from which ink drops are ejected;
- a cartridge holder, on which an ink cartridge for supplying ink to the recording head is detachably mounted;
- a subtank, which stores ink replenished from the ink cartridge and supplies the ink to the recording head;
- a detector, which detects an ink amount contained in the subtank;
- a calculator, which performs calculation of an ink amount consumed by the recording head;
- a counter, which updates a consumed ink amount based on the consumed ink amount calculated by the calculator; and
- a corrector, which corrects the calculation in the calculator based on the consumed ink amount indicated by the counter, when the detector detects that the ink amount in the subtank is a predetermined amount or less.

According to the present invention, there is also provided a method of correcting calculation for an ink amount consumed in a recording head incorporated in an ink jet recording apparatus, the step comprising the steps of:

- providing an ink tank which supplies ink to the recording head;
- providing a counter which indicates an ink amount consumed by the recording head;
- calculating an ink amount consumed by the recording head;
- updating the consumed ink amount indicated by the counter, based on the calculated consumed ink amount;
- monitoring a residual ink amount in the ink tank independently from the counter; and
- correcting the way of calculation, based on the updated consumed ink amount of the counter, when the monitored residual ink amount is predetermined amount or less.

Also in these configurations, the similar advantages as explained the above can be attained. In addition, since the corrector corrects the way of calculation in the calculator based on the count value of the counter when the detector detects that the amount of ink in the subtank is a predetermined amount or less, the calculation may effectively be corrected even when the ink cartridge is being used.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Preferred embodiments of the present invention will be described below in detail with reference to the accompanying drawings.

Figure 1:
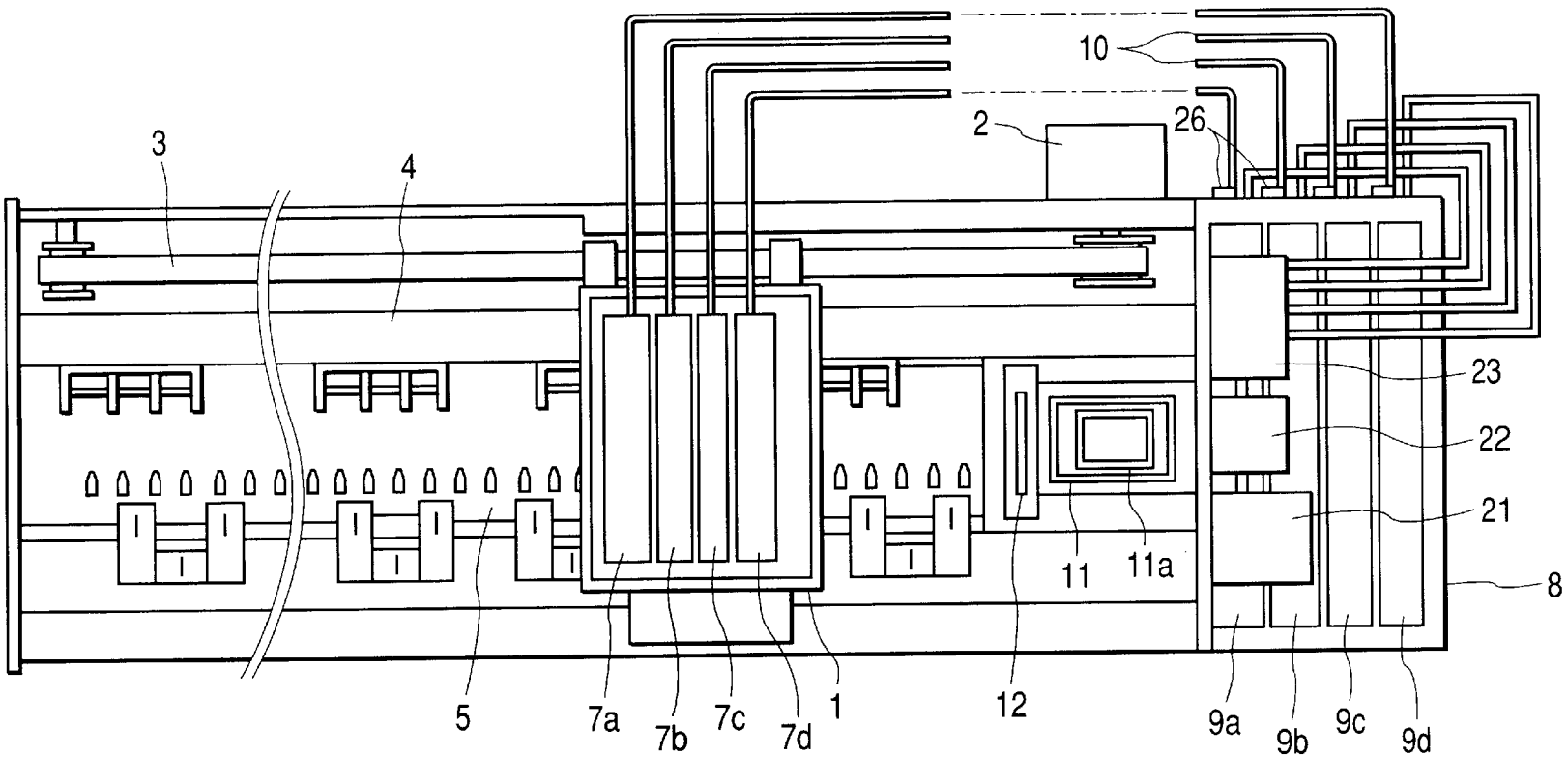
FIG. 1 is a plan view showing an overall arrangement of an ink jet recording apparatus incorporating the present invention.

In FIG. 1, a carriage 1 is reciprocatively moved in the longitudinal direction of a sheet feeding member 5, or in the main scan direction as the width direction of a recording sheet, while being guided by a scan guide member 4 with the aid of a timing belt 3 driven by a carriage motor 2. An ink jet recording head 6 to be described later (not shown in FIG. 1) is mounted on a face of the carriage 1, which is opposed to the sheet feeding member 5.

Subtanks 7*a* to 7*d* for supplying inks to the recording head 6 are mounted on the carriage 1. In the embodiment, the number of subtanks 7*a* to 7*d* is four corresponding to inks (e.g., black ink and color inks of yellow, cyan and magenta), and those tanks temporarily store those inks.

The black ink and the color inks, respectively, are supplied from ink cartridges 9*a* to 9*d* (referred to as main tanks) to the subtanks 7*a* to 7*d*, through flexible ink supply tubes 10 forming ink replenishing passages. Those main tanks 9*a* to 9*d* are loaded into a cartridge holder 8, which is disposed in a main body of the recording apparatus.

A capping device 11 for sealingly capping a nozzle forming surface of the recording head is located at a non-printing area (referred to as a home position) on a moving path of the carriage 1. A cap member 11*a* made of such an elastic material as rubber, which is able to seal the nozzle forming surface of the recording head 6 when it comes in close contact with the nozzle forming surface, is provided on the top surface of the capping device 11. When the carriage 1 is moved to the home position, the capping device 11 moves to the recording head and the nozzle forming surface of the recording head is sealed with the cap member 11*a*.

The cap member 11*a* serves as a lid which seals the nozzle forming surface of the recording head and prevents the nozzle orifices from drying during the rest time of the recording apparatus. The cap member 11*a* is connected to one end of a tube of a suction pump (tube pump) to be described later, and also serves to perform such a cleaning operation as to apply a negative pressure caused by the suction pump to the recording head 6, and to suck ink from the recording head 6 and discharge it outside.

A wiper 12, which is shaped like a strip and made of an elastic material such as rubber, is located adjacent to the printing-area side of the capping device 11. The wiper 12, as the need arises, wipes out the nozzle forming surface of the recording head for cleaning.

The ink supplying system will be described with reference to FIGS. 1 and 2. In those figures, the same and equivalent parts and portions are designated by the same reference numerals. Air compressed by a compressor pump 21 is supplied to a pressure control valve 22, and then supplied to the main tanks 9*a* to 9*d* through a pressure sensor 23 (the main tanks are collectively designated by reference numeral 9 in FIG. 2, and those tanks will frequently be designated by numeral 9).

In the arrangement, air flow passages are diverged from the pressure sensor 23 to the main tanks 9, and the compressed air is applied to the main tanks being loaded into the cartridge holder 8. The pressure control valve 22 serves to keep the value of the air pressure applied to the main tanks 9*a* to 9*d* within a predetermined range of pressure values by releasing the pressure when the air pressure increased by the compressor pump 21 is excessively high by some trouble.

Further, the pressure sensor 23 serves so that it detects the air pressure increased by the compressor pump 21, and controls the driving of the compressor pump 21. When the pressure sensor detects that a value of the air pressure increased by the compressor pump 21 reaches a predetermined pressure value, the pressure sensor stops the operation of the compressor pump 21 upon the detection result. When the pressure sensor detects that a value of the air pressure is below the predetermined value, the pressure sensor controls the compressor pump 21 so that it is driven. Repeating the above sequence of operations, the air pressure applied to the main tanks 9*a* to 9*d* is kept within a predetermined range of pressure values.

Figure 2:
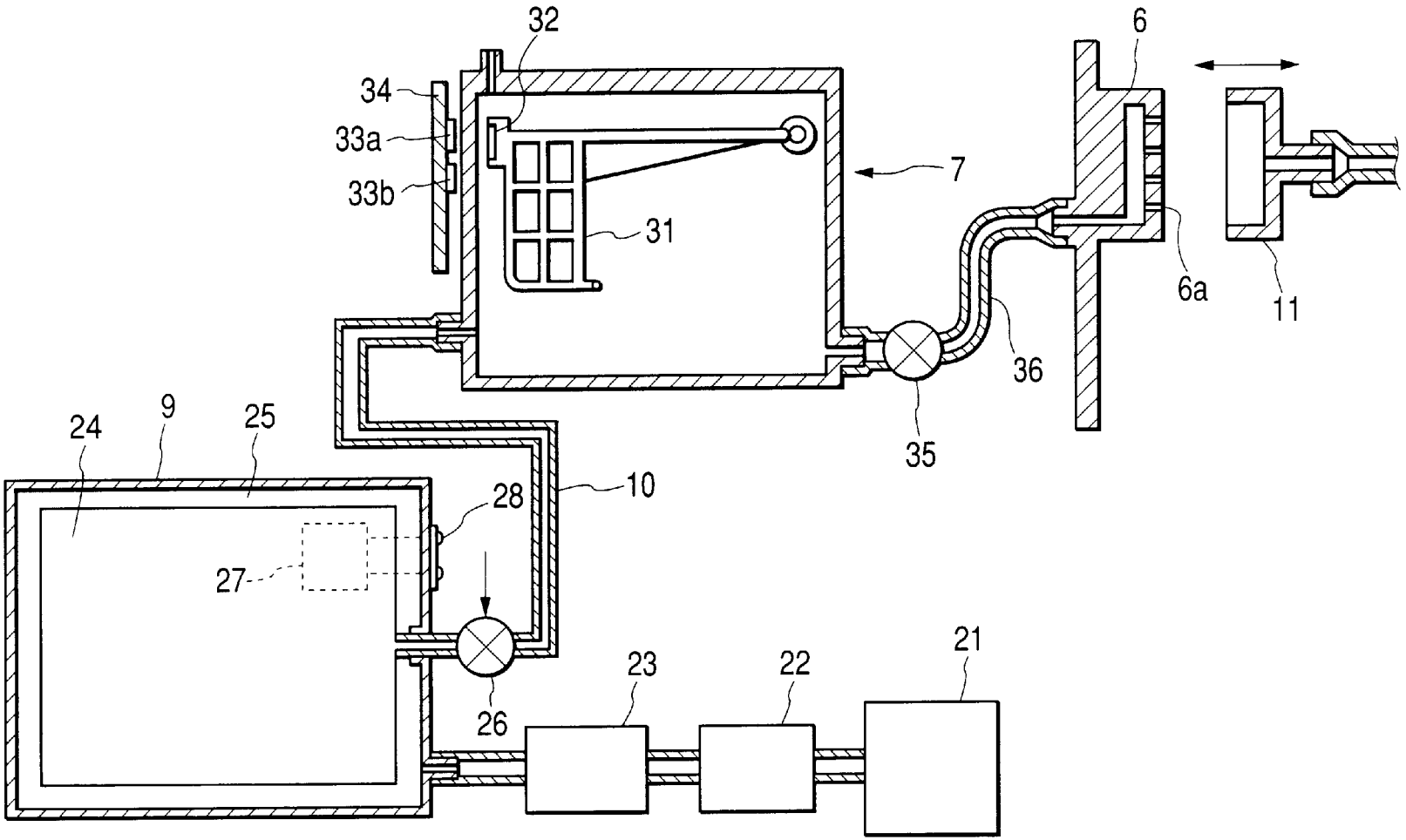
FIG. 2 is a schematic illustration showing an ink supplying system ranging from a main tank to a recording head.

One of the main tanks 9 is roughly illustrated in FIG. 2. A case forming the main tank 9 is hermetically sealed. An ink pack 24 being made of flexible material and filled with ink is located within the case. A space defined by the main tank 9 and the ink pack 24 contained therein form a pressure chamber 25. The air pressure is supplied into the pressure chamber 25, through the pressure sensor 23.

With such a construction, the ink packs 24 contained in the main tanks 9*a* to 9*d* is pressurized by the compressed air, so that ink flows from the main tanks 9*a* to 9*d* to the subtanks 7*a* to 7*d*, under the pressure of the compressed air.

Also as shown in FIG. 2, a memory device 27 for storing information about the main tank 9 is mounted on a part of the case of each main tank 9 as the main tank. Information about the residual amount of the ink in the main tank associated therewith is stored in the memory device 27, as will be described later. As shown in FIG. 2, a terminal 28 for communicating information with the memory device 27 is provided on a part of each main tank 9. When the main tank 9 is loaded to the recording apparatus, the terminal 28 is electrically connected to the recording apparatus, so that communication of information on a residual ink amount in the main tank is performed therebetween.

Ink pressurized in the main tank (9*a* to 9*d*) is supplied to the subtank (7*a* to 7*d*) mounted on the carriage 1, via the ink replenishing valve 26 and the ink supply tube 10, both being associated therewith (generally designated by reference numeral 7 in FIG. 2, and those tanks will frequently be designated by numeral 7).

Figure 7:
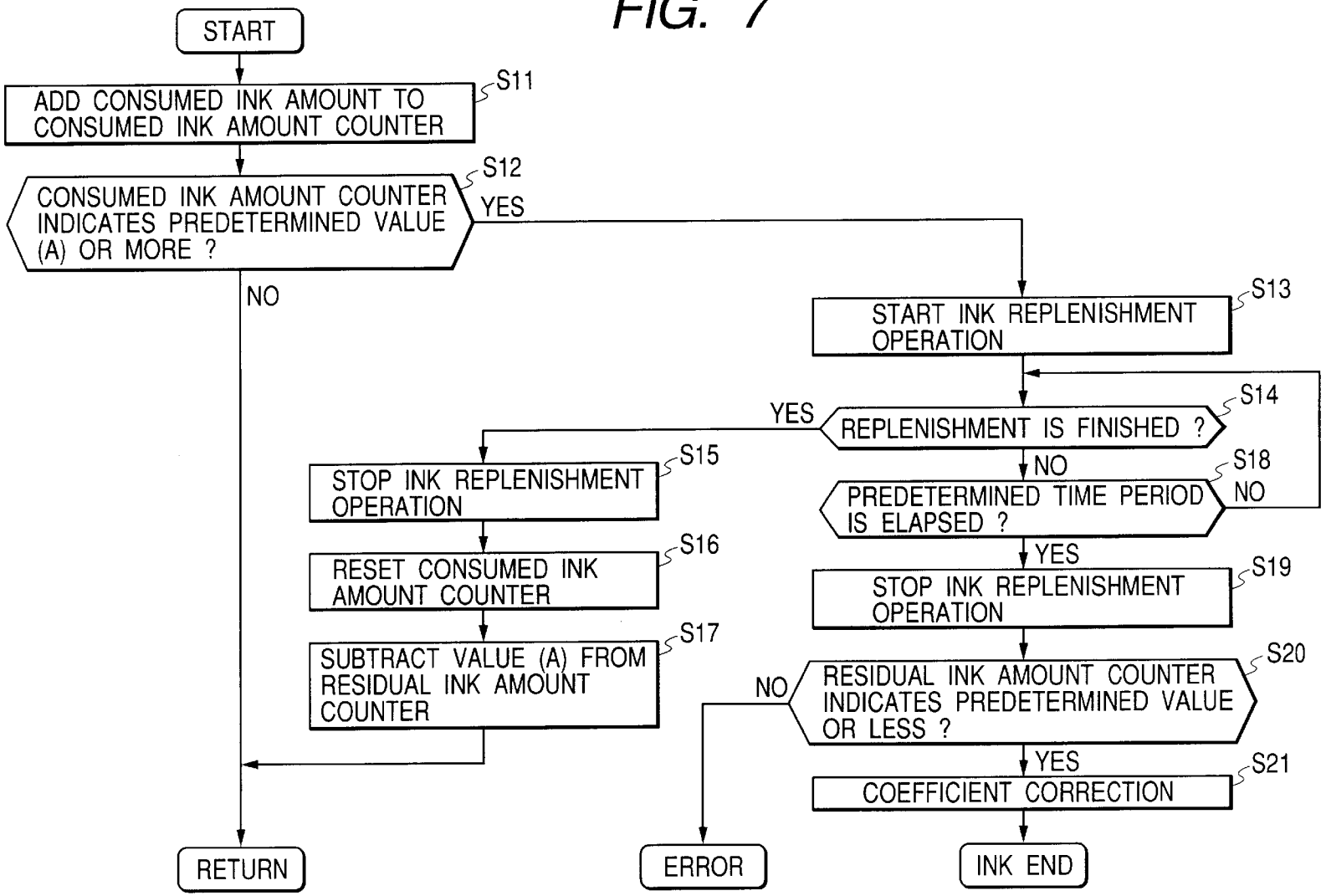
FIG. 7 is a flow chart showing a control routine executed by the configuration shown in FIG. 6.

A basic construction of the subtank 7 shown in FIG. 7 is such that a float member 31 is disposed within the subtank 7, and a permanent magnet 32 is attached to a part of the float member. The details of the subtank 7 will be described later. Magnetoelectric transducers 33*a* and 33*b*, such as hall elements, are mounted on a board 34, and the assembly is attached to the side wall of the subtank 7.

With such a construction, an electric output signals are generated by the hall elements 33*a* and 33*b* in accordance with magnetic flux density of the permanent magnet 32, which depend on a floating position of the float member. They constitute an ink amount detector together with the float member 31.

In the embodiment, the ink amount detector is used for detecting that ink is supplied from each main tank 9 to the subtank 7, and an amount of ink within the subtank has reached a predetermined amount of ink (ink-full state). In this connection, the ink replenishing valve 26 is opened and closed by electrical signals output from the hall elements 33*a* and 33*b*.

When the electrical signals output from the hall elements 33*a* and 33*b* shows that the ink amount in the subtank is below a predetermined amount of ink (ink-low state), the ink replenishing valve 26 is opened. The embodiment includes a consumed ink amount calculator which calculates an ink amount consumed in the subtank, as will be described later. When the hall elements detect the ink-low state, and the calculator judges that the consumption of the ink in the subtank has progressed, the ink replenishing valve 26 is opened. Accordingly, the ink pressurized within the main tank 9 is supplied individually into the subtank or tanks 7 in which the ink consumption has progressed.

The sequence of operations as mentioned above is repeated, and the ink is intermittently supplied from the main tank to the subtank. As a result, each subtank always stores the ink within a predetermined range of ink amount values.

As shown in FIG. 2, ink is supplied from each subtank 7 to the recording head 6, via a valve 35 and a tube 36 connected to the valve. Ink drops are ejected from nozzle orifices 6*a*, which are formed in the nozzle forming surface of the recording head 6, in accordance with print data supplied to an actuator (not shown) of the recording head 6. A tube connected to the capping device 11 is connected to a suction pump (tube pump) to be described later.

Figure 3:
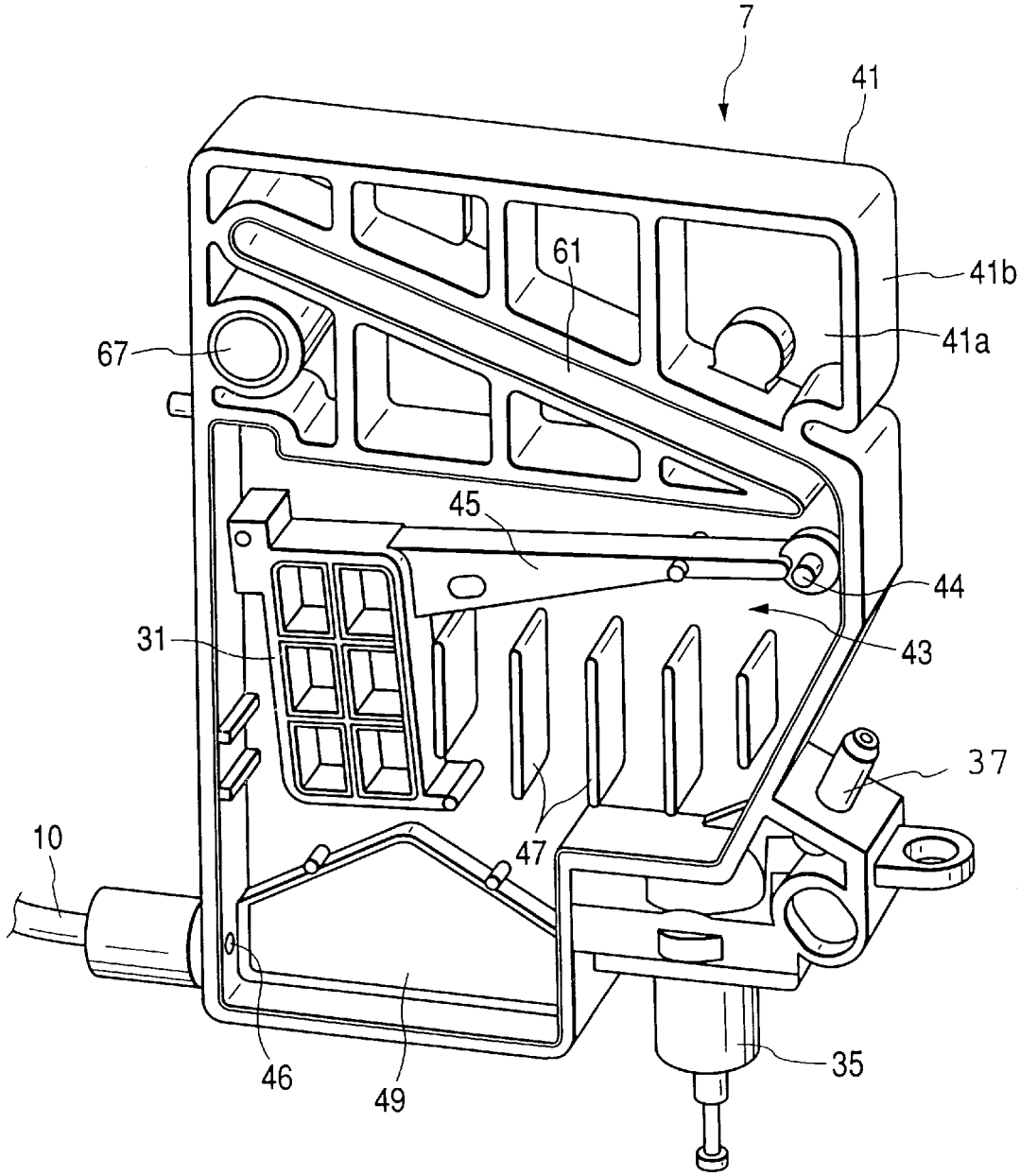
FIG. 3 is a perspective view, partly broken, showing a subtank.
Figure 4:
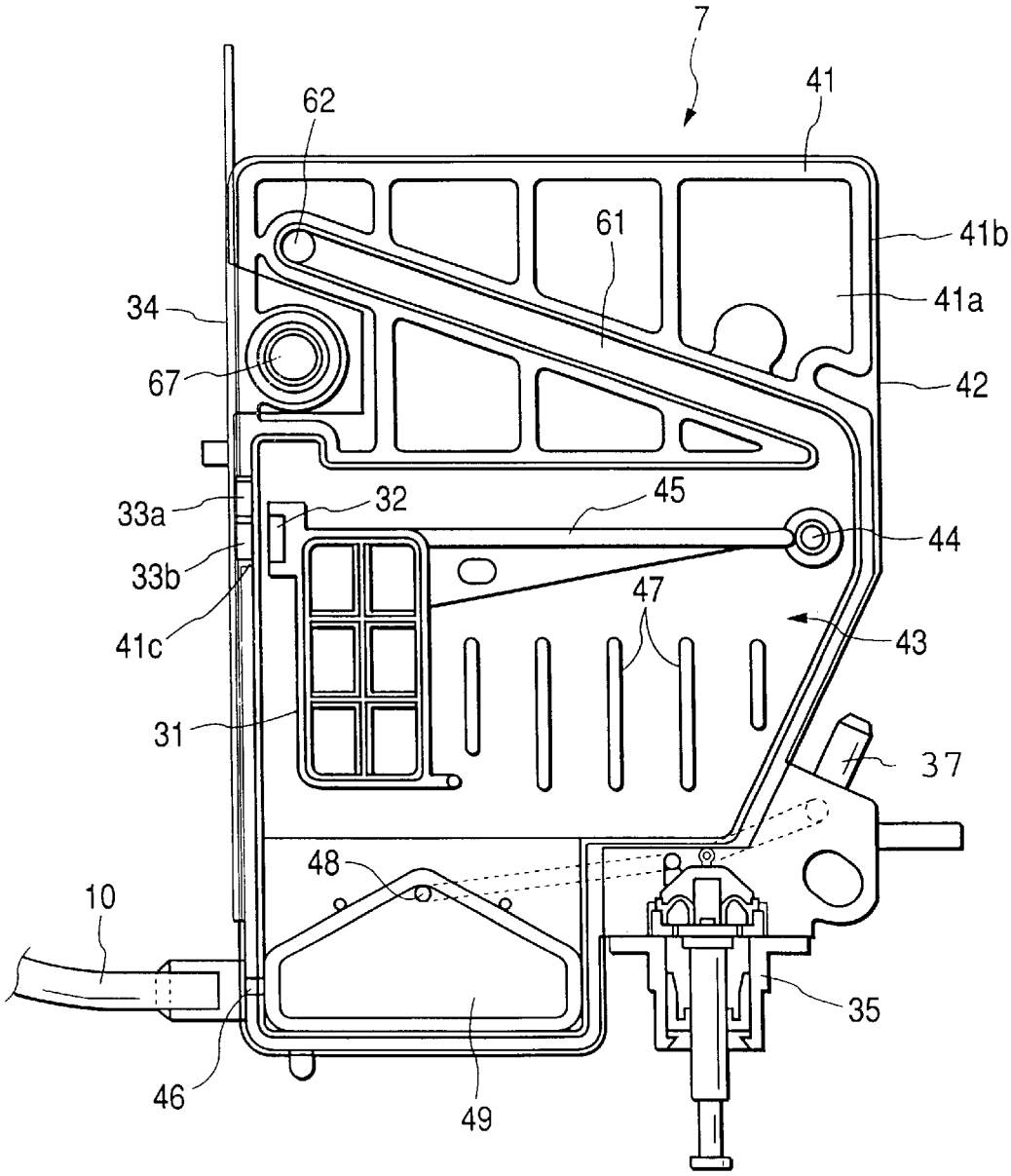
FIG. 4 is a perspective view, partly broken, showing the subtank.
Figure 5:
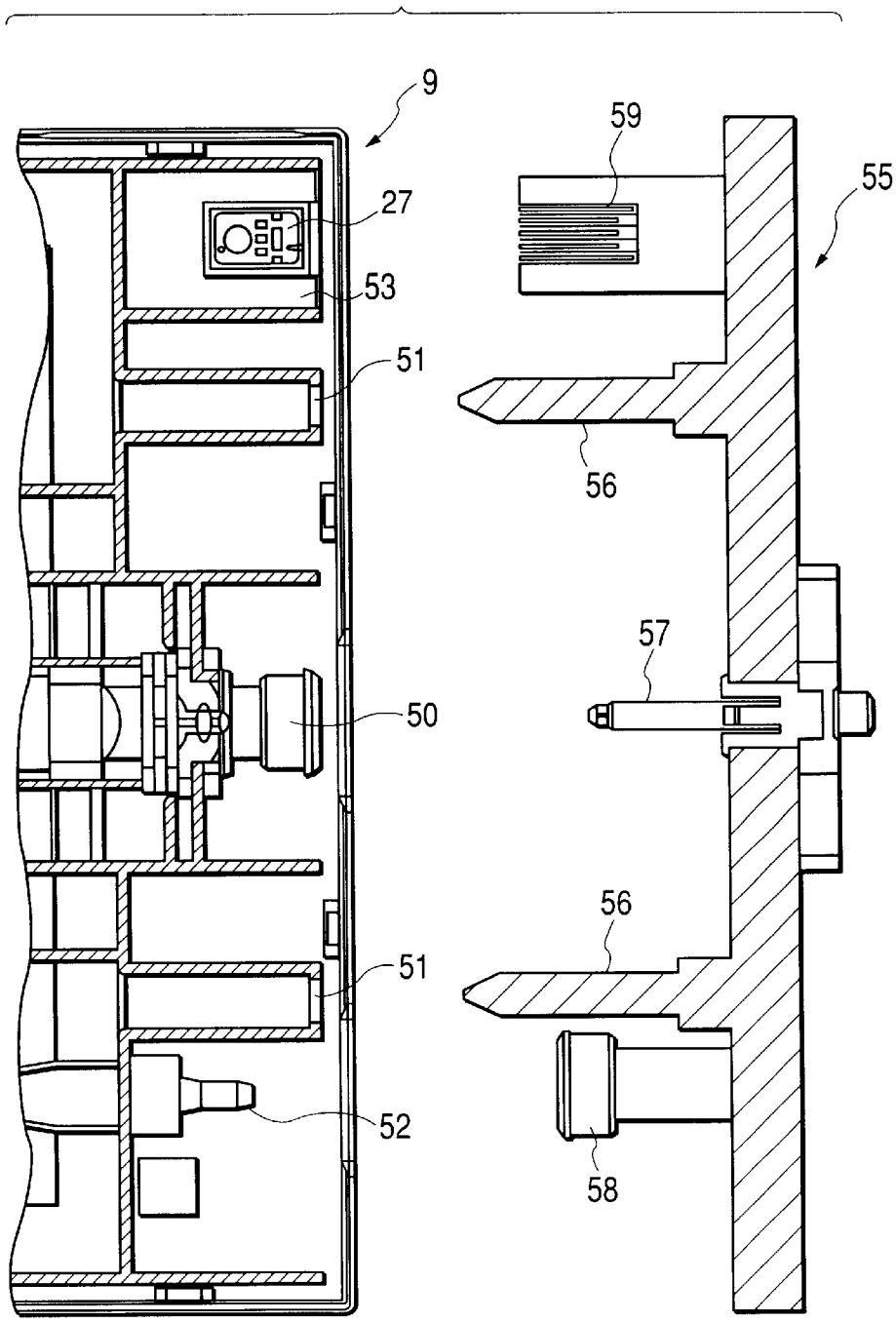
FIG. 5 is a cross sectional view showing a structure including the opposed portions of an ink cartridge and a connector disposed within the cartridge holder.

FIGS. 3 to 5 show one preferred embodiment of the subtank while omitting a part thereof. Equivalent portions as already explained are designated by the same reference numerals.

The subtank 7 takes the form of a rectangular parallelepiped and is flat as a whole. The outer covering of each subtank 7 is a box-like member 41 taking an integral form of one side wall 41*a* and a periphery wall 41*b* continuous to the one side wall. A film-like member 42 (see FIG. 4) made of transparent resin or the like is thermally welded onto the peripheral edge of the opening of the box-like member 41. An ink reservoir 43 is defined by the box-like member 41 and the film-like member 42.

A support shaft 44, which is protruded from the one side wall 41*a* forming the box-like member 41 toward the ink reservoir 43, is integral with the box-like member 41. The float member 31 is vertically pivotable about the support shaft 44 within the ink reservoir 43. In the embodiment, the support shaft 44 is located near the end of the ink reservoir 43 as viewed in the horizontal direction. The float member 31 is formed integral with the free end of a support arm 45, which is pivoted about the support shaft 44.

As shown in FIG. 4, the permanent magnet 32 is mounted on the free end of the support arm 45. The permanent magnet 32 is arranged such that when the support arm 45 is put in a horizontal state, it is positioned near the other end in the ink reservoir 43 as horizontally viewed, viz., it is closest to the hall elements 33*a* and 33*b* mounted on the board 34 attached to the side wall of the subtanks 7.

An ink supply port 46 is formed in a bottom part of the subtank 7 as viewed in the vertical direction, viz., a bottom part of the periphery wall 41*b* in the embodiment. Ink is supplied from the main tank 9 to the ink reservoir 43, via the ink supply tube 10 connected to the ink supply port 46.

The ink supply port 46 of the subtank 7 is formed in a bottom part thereof as viewed in the vertical direction, as described above. Ink supplied from the main tank is fed into the subtank 7, through the bottom part of the ink reservoir 43. Thus, the structure is designed so that ink bubbles are not generated within the ink reservoir 43 at the time of ink supplying.

Within the subtank 7, a plurality of rib members 47 are disposed in a portion except the moving area within which the float member 31 and the support arm 45 move, in order to lessen a chance that the movement of the carriage ruffles the ink within the subtank. In the embodiment, those rib members 47 are integral with the one side wall 41*a* of the box-like member 41 forming the subtank 7,and extend from the one side wall 41*a* toward the ink reservoir 43.

The presence of the rib members 47 reduces a frequency that the ruffling of the ink within the subtank occurs. The result is that an accuracy of detecting a residual ink amount in the main tank 9 by the hall elements 33*a* and 33*b* is improved.

In the subtank 7, an ink deriving port 48 is formed at a position near the ink supply port 46, as shown in FIG. 4. A filter member 49, which is shape like a pentagon (like a home base) and for trapping foreign materials, is disposed covering the ink deriving port 48. Accordingly, the ink stored in the subtank 7 is led to the ink deriving port 48, via the filter member 49.

The ink led out through the ink deriving port 48 flows to the valve 35 located in the lower part of the subtank 7, by way of the back side of the side wall 41*a*. The ink having passed through the valve 35 is likewise led to a connecting port 53 of the tube 36 connected to the recording head 6 by way of the back side the side wall 41*a*.

A passage 61 is slantly formed in the upper half of the subtank 7 communicatively connected to the ink reservoir 43, as shown in FIGS. 3 and 4. An air vent 62 passing through the back side of the side wall 41*a* is formed at the upper end of the passage 61, i.e., at an almost top position of the subtank 7. The air vent 62 allows, on its back side, the air to pass therethrough, and the back side thereof is closed by a water-repellent film for stopping the flowing of ink therethrough.

A recess 41*c* for positioning the hall elements 33*a* and 33*b* is formed in the side wall of the subtank 7 as shown in FIG. 4. With formation of the positioning recess 41*c*, the side wall of the subtank 7 is thinned. Further, a distance between the hall elements 33*a* and 33*b* and a moving locus of the permanent magnet 32 mounted on the float member 31 is more reduced. With this feature, a sensitivity of the hall elements 33*a* and 33*b* when those sense the magnetic flux developed by the permanent magnet 32, is increased. Further, an accuracy in the ink amount detecting operation, which is based on the movement of the float member 31 in the vertical direction in accordance with an amount of ink in the subtank 7.

A through hole 67 is formed in a part of the subtank 7. Accordingly, the subtanks are arranged side by side by utilizing a single support shaft (not shown) passing through those through holes of the subtanks, whereby a subtank unit is formed.

FIG. 5 is a cross sectional view showing a structure including the opposed portions of the main tank 9 as the main tank and a connector 55 disposed within the cartridge holder 8. The main tank 9 as the main tank includes a couple of openings 51 as a positioning member used when it is attached to the recording apparatus. An ink outlet 50 led from the ink packs 24 is mounted on a mid position between the coupled of openings 51. An inlet 52 for the compressed air and a circuit board 53 containing the memory device 27 which communicates information on the main tank associated therewith are provided outside the openings 51 located at two positions.

A couple of positioning pins 56 each shaped like a column are provided on the connector 55 of the cartridge holder 8 side. A couple of positioning openings 51 formed in the main tanks 9 side are applied to the positioning pins 56, respectively.

Thus, the positioning openings 51 are located at two positions of the main tanks 9 side. Accordingly, the main tank 9 as the main tank may be positioned three dimensionally by applying them to the base ends of the two positioning pins 56 of the recording apparatus side. The main tanks 9 is applied to the positioning pins 56. As a result, a hollowed, ink introducing tube 57, which is located at the mid position between the couple of positioning pins 56, is inserted into the ink outlet 50 extended from the ink pack 24, and a state that ink may be led out of the main tank, is set up.

As the result of the attaching of the main tanks 9, the inlet 52 is connected to an air outlet 58 of the cartridge holder 8 side. And a state that the compressed air may be introduced into the main tanks 9 is set up. Further, a terminal unit 59 with a plurality of contact pieces is coupled to the circuit board 53 of the main tank 9 side. This connection allows data communication with the memory device 27 on the circuit 53.

Figure 6:
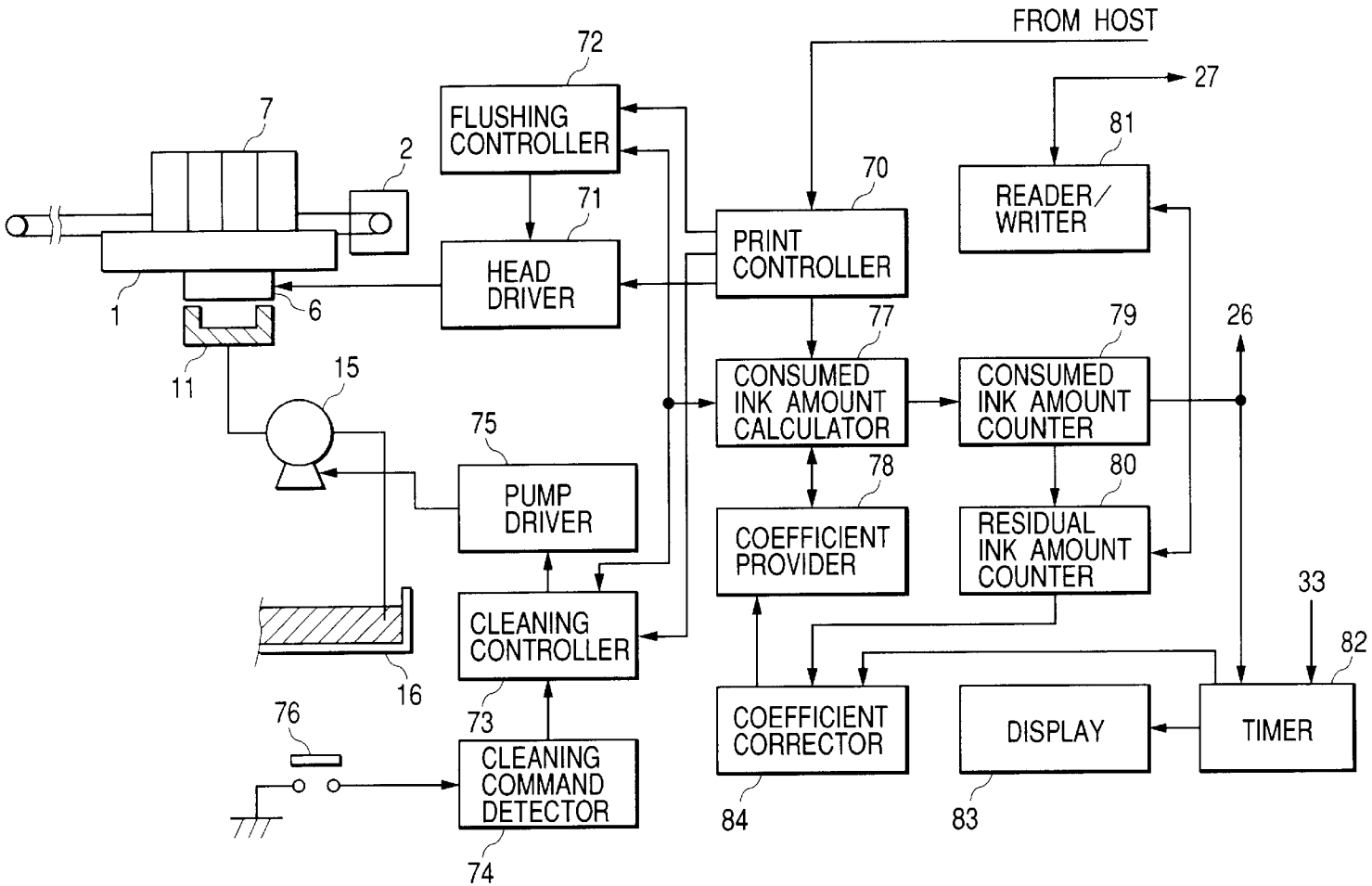
FIG. 6 is a block diagram showing an electrical configuration of the ink jet recording apparatus shown in FIG. 1, which includes an ink state monitor according to a first embodiment of the invention.

FIG. 6 is a block diagram showing an electrical configuration of the recording apparatus. Here, like or equivalent portions already explained are designated by the same reference numerals, for simplicity of explanation, and hence no further description of them will be given. As shown in this figure, the suction pump 15 is connected to the capping device 11 of which the discharging side is connected to the waste ink tank 16.

A print controller 70 generates bit-map data based on print data received from a host computer. The print controller 70 causes a head driver 71 to generate a head drive signal according to the bit-map data, and causes the recording head 6 mounted on the carriage 1 to eject ink. The head driver 71 receives a flushing command signal from a flushing controller 72, and outputs a drive signal for the flushing operation to the recording head 6, in addition to the drive signal based on the print data.

A cleaning controller 73 receives a control signal from a cleaning command detector 74, and controls a pump driver 75 to drive the suction pump 15. By operating a cleaning switch 76 provided on an operation panel of the recording apparatus, the cleaning command detector 74 operates, so that a manual cleaning operation is performed.

The cleaning controller 73 also receives a control signal from the print controller 70. Upon receipt of the control signal, the cleaning controller 73 controls the pump driver 75 and drives the suction pump 15, whereby a cleaning operation is performed.

Control signals are supplied to a consumed ink amount calculator 77, from the print controller 70, flushing controller 72 and cleaning controller 73. The consumed ink amount calculator 77 calculates an ink amount consumed in the subtank 7. Such data as the number of ink drops that are ejected from the recording head 6 in accordance with print data under control of the print controller 70, the number of ink drops ejected from the recording head 6 based on a flushing operation performed by the flushing controller 72 and the number of ink drops ejected from the recording head 6 based on a cleaning operation performed by the cleaning controller 73 are respectively supplied to the consumed ink amount calculator 77.

The consumed ink amount calculator 77 having which received those items of data, accesses a coefficient provider 78 in accordance with the number of ink drops ejected from the recording head 6 based on a printing operation and the number of ink drops ejected from the recording head based on a flushing operation, and calculates an ink amount consumed in the subtank 7 by multiplying those numbers of ink drops by coefficients. The coefficients in the coefficient provider 78 are managed in connection with a weight of the ink drop. A consumed ink amount is calculated by multiplying the numbers of ink drops based on the printing and flushing operations by the weight.

When the cleaning operation is executed, an amount of discharging ink is controlled in accordance with levels of ranked cleaning operations. A consumed ink amount is calculated in accordance with the cleaning operation level every time the cleaning operation is performed.

The thus calculated consumed ink amount in the subtank 7 is transferred to a consumed ink amount counter 79 where it is counted up (added). When the count-up value reaches a predetermined value, a considerable amount of ink has been consumed in the subtank 7. Under the condition that an electric output from the hall element 33*a* and 33*b* indicates an ink-low state, the ink replenishing valve 26 is opened, and ink is supplied from the main tank 9 to the subtank 7.

When the electric output signals from the hall elements shows that as the result of the ink supplying, the amount of ink in the subtank 7 reaches a predetermined value (ink-full state) by the ink supplying operation, the ink replenishing valve 26 is closed as stated above, and at the same time, the count value of the consumed ink amount counter 79 is reset.

The data indicative of the consumed ink amount in the subtank is transferred from the consumed ink amount counter 79 to a residual ink amount counter 80. On the other hand, data indicative of a residual ink amount in the main tank 9 which is stored in the memory device 27 mounted on the subject main tank 9 is previously set in the residual ink amount counter 80 via a reader/writer 81.

The count-up value of the consumed ink amount counter 79 before it is reset is transferred to the residual ink amount counter 80 where the count value of the consumed ink amount counter 79 is subtracted from the count value showing a residual amount of ink in the main tank 9. As a result, the count value of the residual ink amount counter 80 is subtracted as the ink is consumed, and the numerical data is written into the memory device 27 by the reader/writer 81.

A control signal for opening the ink replenishing valves 26 output from the consumed ink amount counter 79 is applied to a timer 82. The timer 82 starts its clocking operation simultaneously with the opening of the ink replenishing valve 26. The timer receives the output signals from the hall elements 33*a* and 33*b*, which are output when the subtank 7 is put in the ink-full state.

When upon receipt of the control signal for opening the ink replenishing valve 26, the timer 82 starts its clocking operation, and when the output signals of the hall elements 33*a* and 33*b*, which are generated when the subtank 7 is in the full ink state, do not arrive even after a predetermined time period elapses, it may be estimated that the main tank 9 is in an ink-end state or that the application of the compressed air to the main tank 9 is insufficient.

In the recording apparatus of the embodiment, as stated above, the compressed air is supplied to the pressure chamber 25 of the main tank 9, and the compressed air causes the ink to be supplied from the main tank 9 to the subtank 7. Accordingly, a time period elapsed from the start of supplying ink to the subtank 7 till it is put in the ink full state is known at the stage of design. For this reason, if the ink supplying to the subtank 7 is insufficient even after a time period having elapsed greatly exceeds that time, it is estimated that the main tank 9 is in an ink-end state or that the application of the compressed air to the main tank 9 is insufficient.

In this case, the supplying operation to the subtank is stopped, and the printing operation of the recording apparatus is stopped. This feature solves the problem that the subtank 7 becomes empty, and effectively prevents air bubbles from entering the ink supplying passage of the recording head 6. In this case, an ink state in the subtank 7 is judged by use of a judging routine to be described later, and a message about the judged ink state is displayed by a display 83.

When the judging routine to be described later judges that the main tank 9 is in the ink-end state, the count value of the residual ink amount counter 80 is transferred to a coefficient corrector 84. The coefficient corrector 84 corrects the coefficient, which is set in the coefficient provider 78, in accordance with the count value of the residual ink amount counter 80 which is presented when the main tank is put in the ink-end state. The coefficient correction by the coefficient corrector 84 will be described with reference to a flow chart shown in FIG. 7.

A flow chart shown in FIG. 7 contains at least the controls of an operation to supply ink to the subtank 7, determination as to whether or not the main tank 9 is in the ink-end state or whether or not some trouble occurs in the compressed air supplying passage, and the execution of correcting the coefficients by the coefficient corrector 84 when the main tank 9 is in the ink-end state. Control routines shown in the flow chart are periodically executed during the printing operation of the recording apparatus.

During the printing operation of the recording apparatus, the step S11 is first executed to add an amount of ink used for the printing to the count of the consumed ink amount counter 79. Specifically, the process of this step is executed such that a consumed ink amount in the subtank 7 calculated by the consumed ink amount calculator 77 shown in FIG. 6 is transferred to the consumed ink amount counter 79, thereby performing the addition of the consumed ink amount. The step S12 is then executed to verify whether or not a count of the consumed ink amount counter is equal to or larger than a predetermined value (A).

This step is for verifying whether or not a count value of the consumed ink amount counter 79 shown in FIG. 6 is in excess of the predetermined value (A). If the count value does not exceed the predetermined value (A) (No at step S12), the subtank has a sufficient free capacity. Accordingly, till the count value exceeds the predetermined value (A), control returns to the start of the program, and repeats the routines of the steps S11 and S12.

When the value of the consumed ink amount counter 79 exceeds the predetermined value (A) in the step S12, control advances to the step S13. In this step, the operation of supplying ink to the subtank 7 starts. This is effected by opening the ink replenishing valve 26. In this case, the step S13 is executed under the condition that the output signals of the hall elements 33*a* and 33*b* show that the ink amount of the subtank 7 is in an ink-low state.

Subsequently, the step S14 is executed to verify as to whether or not the operation of supplying ink to the subtank 7 is completed. To the verification, as stated above, the output signals of the hall elements 33*a* and 33*b* are utilized. In concurrence with the execution of the step S14, the step S18 verifies whether or not a predetermined time period elapses from the start of supplying of ink to the subtank 7. The verification is performed by using the timer 82 shown in FIG. 6. If the supplying of ink to the subtank 7 is completed before the predetermined time period elapses (Yes), the ink supplying operation is stopped in the step S15. This is done by closing the ink replenishing valve 26, as stated above.

In the step S16, the consumed ink amount counter 79 is reset, and in the subsequent step S17, the predetermined value (A) is subtracted from the count of the residual ink amount counter 80. By the subtracting operation, an ink amount of one ink supplying operation to the subtank 7 is subtracted from the count of the residual ink amount counter 80, and the result of subtraction (i.e., the updated residual amount of ink in the main tank 9) is set in the residual ink amount counter 80.

When the supplying of ink to the subtank 7 is not completed (the answer remains No) in the step S14, and the predetermined time has elapsed in the step S18, it is estimated that the main tank 9 is empty or some trouble occurs in the system for supplying the compressed air to the main tank 9. Accordingly, the step S19 is executed to stop the operation of supplying ink to the subtank 7.

Subsequently, the step S20 is executed to judge as to whether or not the count value of the residual ink amount counter 80 is below a predetermined value. If the count value of the residual ink amount counter 80 does not reach the predetermined value (the answer is No), it may be estimated that some trouble occurs in the ink replenishing passage, the compressed air supplying passage, or the like. In this case, the display 83 indicates an error message.

When the count value of the residual ink amount counter 80 has reached the predetermined value (Yes) in the step S20, it may be judged that the main tank is sure to be in an ink-end state (empty). In this case, the display 83 displays an ink-end message. In other words, with provision of the judging process of the step S20, the ink-end state of the main tank 9 can be recognized correctly.

If the step S20 judges that the main tank 9 is in the ink-end state, control advances to the step S21. In the step, the coefficient of the coefficient provider 78 is corrected by the coefficient corrector 84, and the printing operation of the recording apparatus is stopped.

In executing the coefficient correction process by the coefficient corrector 84, a count value of the residual ink amount counter 80 is referred to. When the count value of the residual ink amount counter 80 indicates that the residual ink amount is larger than a predetermined value corresponding to the ink-end state, the coefficient to be multiplied by the number of ink drops ejected from the recording head is corrected to be large, viz., the weight of the ink drop is corrected to be large. As a result, a counting rate of the calculating value in the consumed ink amount calculator 77 is increased.

When the main tank is in an ink-end state and the count value of the residual ink amount counter 80 indicates that the residual ink amount is smaller than the predetermined value, the correction process is performed in the contrary manner to that in the above case. As a result, a counting rate of the calculating value in the consumed ink amount calculator is decreased. Accordingly, by executing such a correction process, a counting accuracy of a residual ink amount in the residual ink amount counter 80 is improved.

In a first embodiment of the invention as described above, in the steps S13 to S20 shown in FIG. 7, when the supplying of ink to the subtank 7 is not completed even after a predetermined time period elapses, and the count value of the residual ink amount counter 80 is below a predetermined value, it is judged that the main tank 9 is in the ink-end state. Another configurations may be adopted to grasp the ink-end state in the main tank 9 as will be discussed below.

Figure 8:
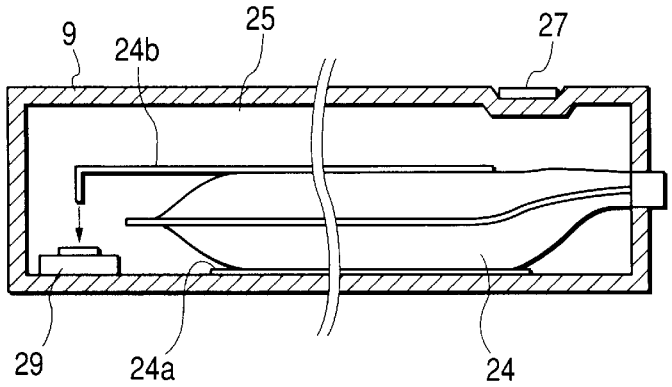
FIG. 8 is a cross sectional view showing an ink state monitor according to a second embodiment of the invention.

FIG. 8 shows a main tank according to a second embodiment of the invention. Here, a detection switch 29 is located within the main tank 9 as the ink-state monitor. Similar to the first embodiment, compressed air is introduced into the main tank 9, and the compressed air pushes the ink out of the ink pack 24, although a mechanical arrangement concerning this is not illustrated in this figure.

The detection switch 29 detects that the ink amount stored in the main tank 9 is below a predetermined value. One face of the ink pack 24 is bonded to the inner face of the case forming the main tank 9 by a double-coated sheet 24*a* or the like. An operating plate 24*b* is likewise bonded to the other face of the ink pack 24.

With this arrangement, when the ink contained in the ink pack 24 reduces in amount (near the ink-end state), a part of the operating plate 24*b* acts to turn, for example, on the detection switch 29 with the shrinking of the ink packs 24. Accordingly, the decision step S29 shown in FIG. 7 may be executed by verifying a state of the detection switch 29.

When the detection switch 29 is turned on, judgment of the ink-end state may be made, and the process of the step S21 shown in FIG. 7 is executed. When the detection switch 29 is tuned off, it may be considered that some trouble occurs in the ink replenishing passage, the compressed air supplying passage, or the like. In this case, the display 83 indicates an error message.

In the embodiments mentioned above, the compressed air is introduced into the pressure chamber 25 of the main tank 9 and ink is supplied to the subtank 7. It is evident that the present invention is applied to other recording apparatus than the above-mentioned one. In the recording apparatus in which ink is supplied to the subtank 7 by generating a negative pressure in the subtank 7, or the recording apparatus in which a water head difference is created between the main tank 9 and the subtank 7 to cause an ink flow therebetween, a physical detector as shown in FIGS. 9 through 11 may be used for the ink state monitor.

Figure 9A:
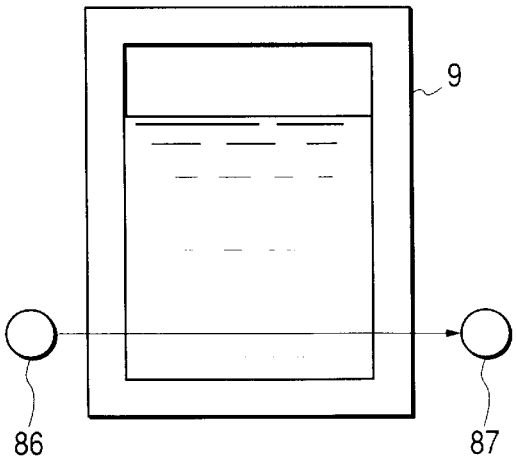
FIGS. 9A and 9B are cross sectional views showing an ink state monitor according to a third embodiment of the invention.
Figure 9B:
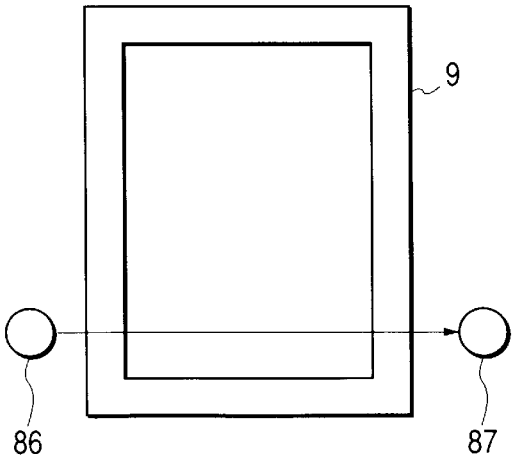

FIGS. 9A and 9B show an ink-state monitor according to a third embodiment of the invention. In this embodiment, a case forming the main tank 9 storing ink therein is made of transparent resin. A light source 86 and a photo sensor 87 are disposed on both side of a lower part of the case. When a great amount of ink is contained in the main tanks 9 as shown in FIG. 9A, a light emitted from the light source 86 is intercepted, so that the photo sensor 87 does not sense the emitted light. When the amount of ink in the main tanks 9 decreases below a predetermined value of ink amount (a light path from the light source 86 to the photo sensor 87) as shown in FIG. 9B, the photo sensor 87 senses a emitted light emitted from the light source 86 passes through the case of transparent resin. In this case, it is judged that the residual ink amount is smaller than the predetermined value.

Accordingly, the decision step S20 shown in FIG. 7 may be carried out depending on whether or not the photo sensor 87 senses the light emitted from the light source 86 in the construction shown in FIG. 9. When the photo sensor 87 senses the emitted light, control judges that the subtank 7 is in the ink-end state, and executes the process of the step S21 shown in FIG. 7. When the photo sensor 87 fails to sense the emitted light, it may be considered that some trouble occurs in the ink replenishing passage or the compressed air supplying passage, or the like. In this case, an error message is displayed by the display 83 as stated above.

Figure 10A:
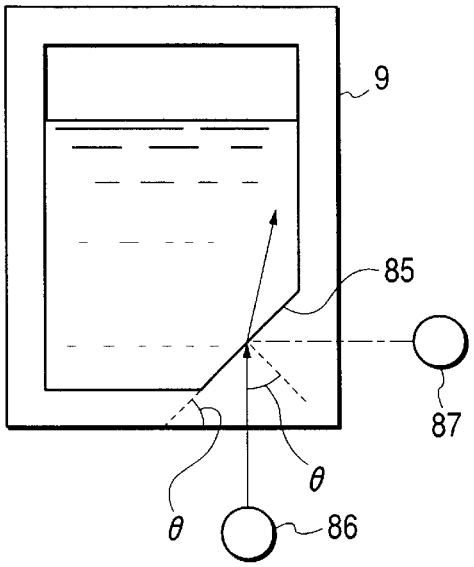
FIGS. 10A and 10B are cross sectional views showing an ink state monitor according to a fourth embodiment of the invention.
Figure 10B:
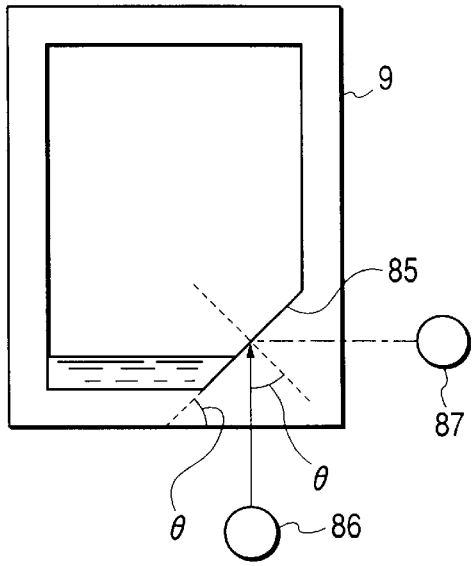
Figure 11:
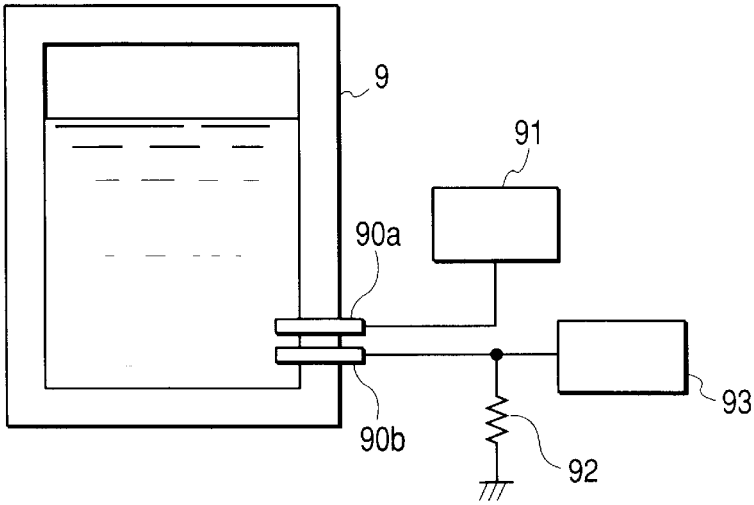
FIG. 11 is a cross sectional view showing an ink state monitor according to a fifth embodiment of the invention.

FIGS. 10A and 10B show an ink-state monitor according to a fourth embodiment of the invention. In this embodiment, an outer case of the main tank 9 containing ink therein is likewise made of transparent resin. A prism part 85 is formed at a corner defined between the bottom part and the side wall. An incident angle of light emitted from the light source 86 to the prism part 85 and a reflection angle of light from the prism part 85 to the photo sensor 87 are each set at $\theta$ (=45°). An residual ink amount of the ink in the main tank is detected by using a difference between a critical angle of the total reflection determined by refractive indices at a boundary between the ink in the main tank 9 and the resin of the case and a critical angle of the total reflection determined by refractive indices at a boundary between the air and the resin forming the case.

As shown in FIG. 10A, when a great amount of ink is contained in the main tanks 9, an emitted light from the light source 86 is not sensed by the photo sensor 87 with the prism part 85 interposed therebetween, and the photo sensor 87 fails to sense the emitted light from the light source 86. When the amount of the ink in the main tanks 9 decreases to be below the predetermined value (the optical path ranging from the light source 86 to the prism part 85), the emitted light from the light source 86 is reflected to the photo sensor 87 as shown in FIG. 10B, and the photo sensor 87 senses the emitted light from the light source 86.

Thus, also in this configuration, the decision step S20 shown in FIG. 7 may be executed depending on whether or not the photo sensor 87 senses the emitted light from the light source 86. When the photo sensor 87 senses the light (FIG. 10B), control makes the decision of the ink end, and the process of the step S21 shown in FIG. 7 is executed. When the photo sensor 87 fails to detect the emitted light (FIG. 10A), it may be considered that some trouble occurs in the ink replenishing passage, the compressed air supplying passage or the like. In this case, an error message is displayed by the display 83.

FIG. 11 shows an ink-state monitor according to a fifth embodiment of the invention. In this embodiment, a couple of electrode terminals 90*a* and 90*b* extending inward of the tank are disposed near the bottom part of the case of the main tank 9 containing ink therein. A predetermined voltage is applied to the electrode terminal 90*a* from a constant voltage source 91. A resistor 92 is connected between the electrode terminal 90*b* and a reference potential (ground level). A voltage detector 93 for detecting a potential across the resistor 92 is connected to the electrode terminal 90*b*.

With this arrangement, when such an amount of ink as to allow an electrical conduction to be set up between the electrode terminals 90*a* and 90*b* is left in the main tank, a voltage higher than a predetermined value is detected by the voltage detector 93. When a residual ink amount in the main tank is at a level near that of the ink-end state, a voltage detected by the voltage detector 93 greatly decreases. Accordingly, by utilizing this construction, a residual ink amount in the main tank can be detected.

When a voltage detected by the voltage detector 93 is below the predetermined value, control judges that the subtank is in the ink-end state, and executes the process of the step S21 shown in FIG. 7. When a voltage detected by the voltage detector 93 is in excess of the predetermined value, it may be estimated that some trouble occurs in the ink replenishing passage, the compressed air supplying passage, or the like. In this case, the display 83 indicates an error display.

In the embodiments mentioned above, when control judges that the main tank is in the ink-end state, the coefficients, which are used for the calculating of a weight of the ink drop being ejected by the printing operation or the flushing operation, are corrected. With this, an accuracy of judging an ink end in the main tank to be used in the subsequent ink-end judging operation is improved. In an alternative, a correction value is stored every correction operation. Those correction values are averaged, and the averaged value is used as a default or a correction value selected by the user may be used.

As a sixth embodiment of the invention, a count value of the consumed ink amount counter 79 may be referred to so that the coefficient for calculating the weight of the ink drop is corrected by using the count value, when the ink amount detector using the hall elements 33*a* and 33*b* judges that an ink level in the main tanks 9 is in a LOW level.

Specifically, the subtank 7 is replenished with ink till an amount of replenished ink in the subtank 7 reaches a predetermined value (ink-full state) by utilizing the electrical outputs from the hall elements 33*a* and 33*b*. Thereafter, when the electrical signals output from the hall elements 33*a* and 33*b* indicate the ink-low state as the ink is consumed, and when a count value of the consumed ink amount counter 79 exceeds a predetermined value, the count value of the consumed ink amount counter 79 is transferred to the residual ink amount counter 80.

Accordingly, the ink amount as defined between the ink full state and the ink-end state, which are based on the output signals of the hall elements 33*a* and 33*b*, somewhat varies among the recording apparatus. However, it is almost fixed in value in one and the same recording apparatus. Therefore, the coefficient in calculating the weight of the ink drop may be corrected by referring to a count value of the consumed ink amount counter 79, which presented when the count value of the consumed ink amount counter 79 is transferred to the ink residual ink amount counter 80.

When the referred count value of the consumed ink amount counter 79 is larger than the predetermined value, the coefficient for the calculating of the weight of the ink drop is substantially large. In this case, the coefficient to be multiplied by the number of ink drops ejected from the recording head is corrected to be small.

When the referred count value of the consumed ink amount counter 79 is smaller than the predetermined value, the coefficient for the calculating of the weight of the ink drop is substantially small. In this case, a correction process is carried out in the contrary fashion as compared with the above case, whereby the coefficient to be multiplied by the number of ink drops ejected from the recording head is corrected to be large. By performing the correction operations, the coefficient may be corrected even when the main tank is being used. As a result, an accuracy of counting a residual ink value of the residual ink amount counter 80 is increased.

This process of correcting the coefficient based on the count value of the consumed ink amount counter 79 may be executed solely or in cooperation with the coefficient correcting process in the control routine shown in FIG. 7.

Figure 12:
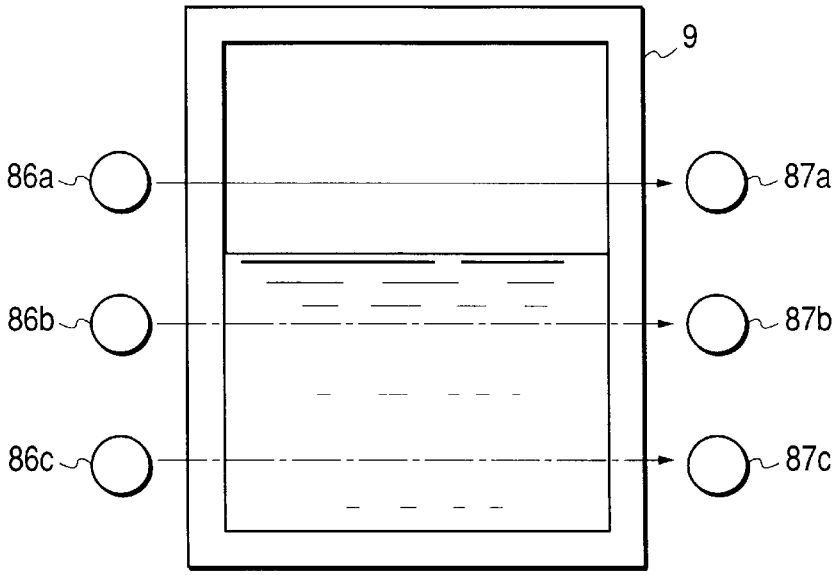
FIG. 12 is a cross sectional view showing an ink state monitor according to a seventh embodiment of the invention.

There will be described below embodiments wherein the coefficient used in calculating the weight of the ink drop is corrected when the main tank is being used. FIG. 12 shows an ink-state monitor according to a seventh embodiment of the invention, which has a similar configuration to the third embodiment as shown in FIGS. 9A and 9B. Specifically, the case forming the main tank 9 in which the ink is stored is made of transparent resin.

The ink-state monitor include plural pairs of the light sources and the photo sensors, and the light source and the photo sensor of each pair are located on both sides of the case. Specifically, in the embodiment, a light source 86*a* and a photo sensor 87*a* of a first pair are oppositely disposed in an upper part of the main tank 9 as viewed in the vertical direction when it is installed. A light source 86*b* and a photo sensor 87*b* of a second pair are oppositely disposed in a middle part of the main tank 9. A light source 86*c* and a photo sensor 87*c* of a third pair are oppositely disposed in a lower part of the main tank 9. The first to third photo sensors 87*a* to 87*c* successively receive the emitted light from the light sources 86*a* to 86*c* as the ink decreases in level within the main tank 9. Accordingly, the embodiment is capable of grasping an amount of ink stored in the cartridge in three steps.

According to this configuration, when the ink surface passes each of the positions where the first to third photo sensors 87*a* to 87*c* are disposed, a consumed ink amount is actually detected from the ink level thereat. Assuming that a residual ink amount in the main tank 9 when the first photo sensor 87*a* generates a detection signal is Va, and a residual amount of ink in the main tank 9 when the second photo sensor 87*b* generates a detection signal is Vb, then a difference "Va−Vb" indicates an actual consumed ink amount.

Assuming that a count value of the ink residual ink amount counter 80 when the first photo sensor 87*a* generates a detection signal is Ca, and a count value of the ink residual ink amount counter 80 when the second photo sensor 87*b* generates a detection signal is Cb, then a difference "Ca−Cb" indicates a calculated consumed ink amount. Hence, "(Va−Vb)−(Ca−Cb)" as a difference between the actual consumed ink amount and the calculated consumed ink amount is an error in the calculation. Therefore, in this embodiment, the error is calculated when the ink surface passes the position of the second photo sensor 87*a*, and the coefficient in calculating the weight of the ink drop may be corrected.

When "Ca−Cb" is larger than "Va−Vb", the coefficient used in calculating the weight of the ink drop is substantially large. In this case, the coefficient to be multiplied by the number of ink drops ejected from the recording head is corrected to be small. When "Ca−Cb" is smaller than "Va−Vb", the coefficient used in calculating the weight of the ink drop is substantially small. In this case, the coefficient to be multiplied by the number of ink drops ejected from the recording head is corrected to be large.

When the ink consumption in the main tank 9 has progressed, and when the third photo sensor 87*c* generates a detection signal, viz., the ink surface falls to the position where the third photo sensor 87*c* is disposed, a similar correcting process is performed. In this case, assuming that a residual amount of ink in the main tank 9 when the second photo sensor 87*b* generates a detection signal is Vb, and a residual amount of ink in the main tank 9 when the third photo sensor 87*c* generates a detection signal is Vc, then a difference "Vb−Vc" indicates an actual consumed ink amount.

Assuming that a count value of the ink residual ink amount counter 80 when the second photo sensor 87*b* generates a detection signal is Cb, and a count value of the ink residual ink amount counter 80 when the third photo sensor 87*c* generates a detection signal is Cc, then a difference "Cb−Cc" indicates a calculated consumed ink amount. Therefore, the error is calculated in a similar manner, and the coefficient to be multiplied by the number of ink drops ejected from the recording head may be corrected.

Figure 13:
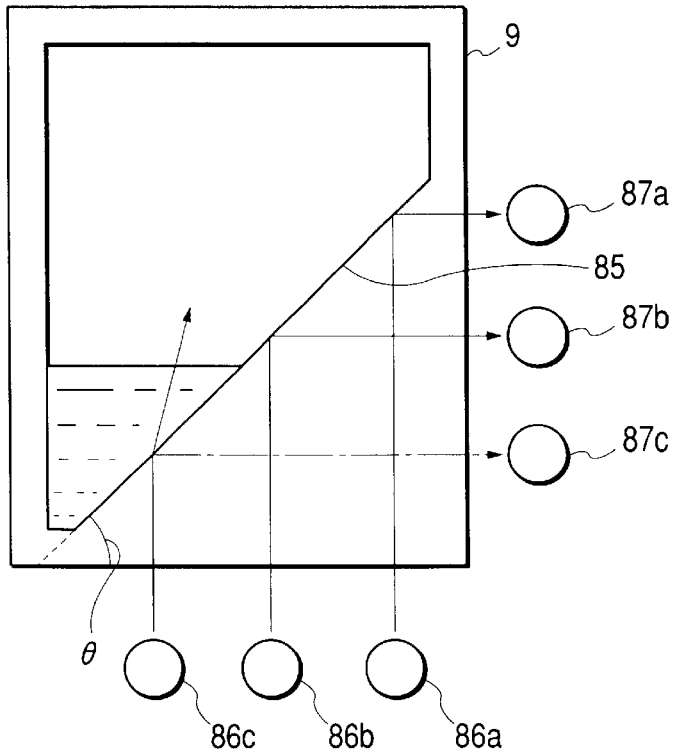
FIG. 13 is a cross sectional view showing an ink state monitor according to an eighth embodiment of the invention.

FIG. 13 shows an ink-state monitor according to an eighth embodiment of the invention, which has a similar configuration to the fourth embodiment shown in FIGS. 10A and 10B. An outer case of the main tank 9 containing ink therein is likewise made of transparent resin. A prism part 85 is formed at a corner defined between the bottom part and the side wall. A first pair of a light source 86*a* and a photo sensor 87*a* is provided such that the light source and the photo sensor are disposed orthogonally to each other, while facing the prism part 85. A second pair of a light source 86*b* and a photo sensor 87*b*, and a third pair of a light source 86*c* and a photo sensor 87*c* are likewise provided such that those elements of each combination are disposed orthogonally to each other. The light emitted from the respective light sources (86*a* to 86*c*) incident on the prism part 85 at different portions from each other so as to correspond to the upper part, the mid part and the lower part of the main tank 9.

According to this configuration, the first to third photo sensors 87*a* to 87*c* successively receive the reflected light from the prism part 85 as the ink decreases in level within the main tank 9. Therefore, as in the seventh embodiment shown in FIG. 12, a consumed ink amount in the main tank 9 is actually detected from the detection of the photo sensors. An error in the calculation may be derived as discussed in the seventh embodiment. As a result, the coefficient to be multiplied by the number of ink drops ejected from the recording head may be corrected.

Figure 14:
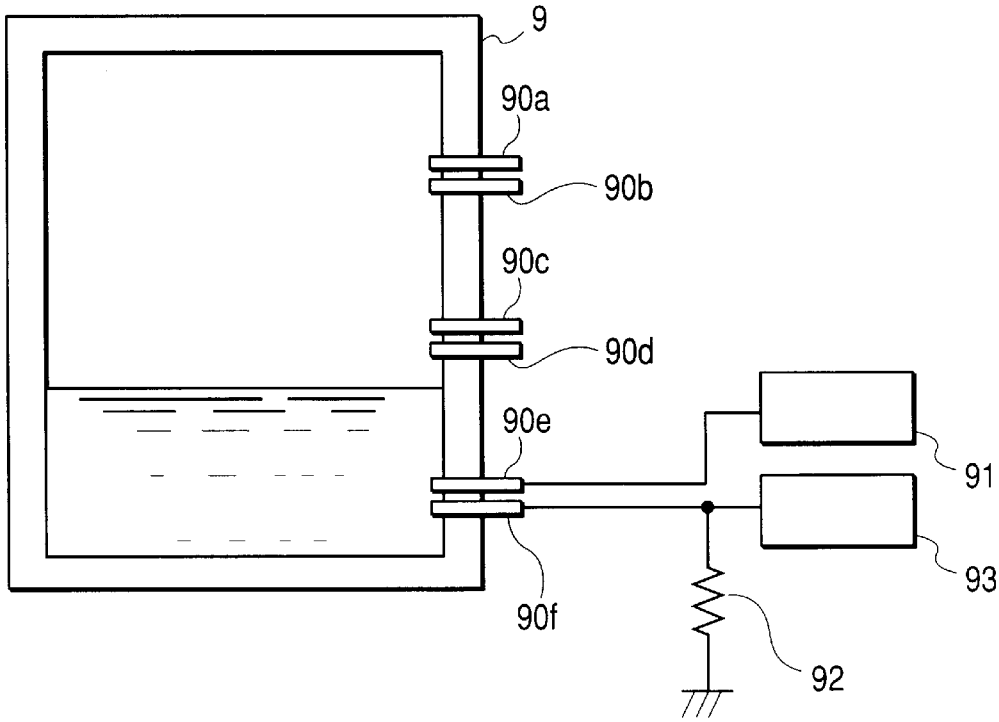
FIG. 14 is a cross sectional view showing an ink state monitor according to a ninth embodiment of the invention.

FIG. 14 shows an ink-end monitor according to a ninth embodiment of the invention, which has a similar configuration to the fifth embodiment shown in FIG. 11. As shown, three pairs of electrode terminals are put in the side wall of an outer case of the main tanks 9 containing ink therein, while being spaced from one another in the vertical direction of the main tank 9. In FIG. 14, although a constant voltage source 91 and a voltage detector 93 are connected to the third pair of electrode terminals 90*e* and 90*f*, the first pair of electrode terminals 90*a* and 90*b* and the second pair of electrode terminals 90*b* and 90*c* are each also connected to a constant voltage source and a voltage detector in a similar manner. The constant voltage source 91 and the voltage detector 93 operate as explained with reference to FIG. 11.

According to this configuration, a detect voltage of the voltage detector 93 connected to the associated electrode terminals greatly decreases as the ink decreases in level within the main tank 9. Accordingly, an actual ink consumption state in the main tanks 9 can be known by detecting this state of voltage drop. An error in the calculation may be derived as discussed in the seventh embodiment. As a result, the coefficient to be multiplied by the number of ink drops ejected from the recording head may be corrected.

In the embodiments shown in FIGS. 12 to 14, three ink levels are used for detecting the amount of ink in the main tank 9, for ease of explanation. If required, the number of detection ink levels may be increased to be more than three ink levels.

According to the configurations of the sixth to ninth embodiments, the coefficient correction may be performed even when the main tank is being used. Accordingly, a counting accuracy of an ink residual amount value in the ink residual ink amount counter 80 is enhanced.

In the above embodiments, the coefficient to be multiplied by the number of ink drops ejected from the recording head is corrected and updated. It is known that a viscosity of ink varies depending substantially on temperature of an environment where the recording apparatus is installed, in particular temperature when the recording head is driven. Exactly, where temperature is low, a viscosity of ink is large, while where it is high, the ink viscosity is small. Accordingly, where temperature is low and the ink viscosity is large, an ink drop ejected from the nozzle orifice of the recording head is substantially small. Conversely, when the temperature is high and the ink viscosity is small, the ink drop ejected from the nozzle orifice of the recording head is substantially large.

Accordingly, the ambient temperature of the recording apparatus installed will also create an error in the count value indicative of a residual ink amount in the ink residual ink amount counter 80. For this reason, it is desirable to execute the coefficient correcting process in accordance with an environment where the recording apparatus is operated. The temperature-dependent coefficient correction process is preferably executed in the following way. In a cold region (viz., temperature in a place where the recording apparatus is installed is low), the coefficient to be multiplied by the number of ink drops ejected is corrected to be small. In a warm region (viz., temperature in a place where the recording apparatus is installed is relatively high), the coefficient to be multiplied by the number of ink drops ejected is corrected to be large. By so doing, the temperature dependency of the recording apparatus may be lessened.

As a tenth embodiment of the invention, it is preferable that a temperature detector is placed within the recording apparatus, particularly at a position close to the recording head, and the coefficient is sequentially corrected in accordance with temperature information derived from the temperature detector. In an alternative, the user sets a temperature on the operation panel of the recording apparatus, and the coefficient is corrected in accordance with the temperature as set. In another alternative, the utility of the print driver installed to the host computer, which is for supplying print data to the recording apparatus, is designed to as to allow the user to set temperature.

In the recording apparatus thus constructed, a counting accuracy of an ink residual amount value in the ink residual ink amount counter 80 is improved. Therefore, the following control is exactly performed: At the time of activation of the recording apparatus, at the time of replacement of the main tank or at the time of page break during the printing operation, a residual ink amount indicated by the residual ink amount counter 80 is referred to, and when the residual ink amount is below an ink amount corresponding to one page of B0 size paper, a message of an ink-end state is displayed, and the operation of the recording apparatus is stopped. With this feature, there is no chance that the printing operation is interrupted and a color reproduction of the printed matter changes. Further, where the pigment-dispersed ink is used as described above, the ink in the main tank may be used up completely.

If the coefficient correcting process is repeatedly executed for several times of the replacement of the main tank or it is sequentially executed during the use of the main tank, the judging accuracy may be improved. With this, variations of the judging results of the different recording apparatus can be made small.

As seen from the foregoing description, according to the present invention, the coefficient used in the calculation of an ink amount consumed in the recording head is corrected when the ink-state monitor judges that the main tank is in the ink-end state or during the main tank is being used. Therefore, an accuracy of detecting a residual ink amount in the main tank is enhanced. This technical feature provides controls, such as a control to leave a minimum amount of ink in an exact level.

What is claimed is:

1. An ink jet recording apparatus, comprising:

a recording head, from which ink drops are ejected;

a cartridge holder, on which an ink cartridge for supplying ink to the recording head is detachably mounted;

a calculator, which performs calculation of an ink amount consumed by the recording head;

a first counter, which updates a residual ink amount in the mounted ink cartridge based on the consumed ink amount calculated by the calculator;

a monitor, which monitors an ink amount contained in the mounted ink cartridge to judge at least an ink-end state in which the ink amount in the ink cartridge is a predetermined amount or less; and a corrector, which corrects the calculation in the calculator based on a difference between the ink amount contained in the ink cartridge monitored by the monitor and the residual ink amount indicated by the first counter, when the monitor judges that the mounted ink cartridge is in the ink-end state.

2. The ink jet recording apparatus as set forth in claim 1, wherein the calculator multiplies a coefficient by the number of ink drops ejected from the recording head at least when a printing operation is performed and when a flushing operation is performed.

3. The ink jet recording apparatus as set forth in claim 2, wherein the corrector corrects the coefficient.

4. The ink jet recording apparatus as set forth in claim 2, wherein the coefficient is managed in accordance with a weight of each ink drop.

5. The ink jet recording apparatus as set forth in claim 2, wherein the calculator performs the calculation every time when a cleaning operation of the recording head is performed.

6. The ink jet recording apparatus as set forth in claim 1, further comprising a subtank, which stores ink replenished from the ink cartridge and supplies the ink to the recording head, wherein the monitor judges the ink-end state when a predetermined amount of ink is not replenished from the ink cartridge to the subtank, when a predetermined time period has elapsed since the ink replenishment is started.

7. The ink jet recording apparatus as set forth in claim 6, wherein:

the ink cartridge and the subtank are connected via a replenishing passage provided with a valve;

the subtank includes a detector which detects an ink amount contained in the subtank;

the valve is opened when the consumed ink amount calculated by the calculator reaches a predetermined value; and the valve is closed when the detector detects an ink-full state in which the ink replenished in the subtank reaches a predetermined amount.

8. The ink jet recording apparatus as set forth in claim 7, wherein:

the monitor includes a timer which starts clocking when the valve is opened; and the monitor judges the ink-end state when the ink-full state is not detected by the detector when the timer clocks a predetermined time period.

9. The ink jet recording apparatus as set forth in claim 7, wherein the detector includes a float member which floats on the ink contained in the subtank, and a signal generator which generates an electric signal varied in accordance with a position of the float member in the subtank.

10. The ink jet recording apparatus as set forth in claim 6, further comprising an air compressor, wherein:

the ink cartridge includes an air-tight casing, a flexible ink pack containing ink therein, which is accommodated within the casing; and air compressed by the air compressor is applied to a space defined between the casing and the ink pack so that the ink pack is contracted in accordance with the ink replenishment to the subtank.

11. The ink jet recording apparatus as set forth in claim 10, wherein the monitor includes a plate member provided on the ink pack and a switch member which is operated by the plate member in accordance with the contraction of the ink pack.

12. The ink jet recording apparatus as set forth in claim 1, wherein the ink-end state judged by the monitor is effected only when the updated residual ink amount of the first counter is a predetermined value or less.

13. The ink jet recording apparatus as set forth in claim 1, wherein:

the monitor refers to the residual ink amount indicated by the first counter when the apparatus is activated, when the ink cartridge is replaced, and when a printing operation is paused to feed a next recording sheet; and operations of the recording apparatus is stopped when the monitor judges the ink-end state.

14. The ink jet recording apparatus as set forth in claim 1, wherein:

the monitor includes a transparent part formed on at least a lower portion of the ink cartridge, at least one pair of a light source and a photo sensor, which are opposed to each other through the transparent part; and the monitor judges the ink-end state when an ink level in the ink cartridge lowers an optical path ranging from the light source to the photo sensor.

15. The ink jet recording apparatus as set forth in claim 1, wherein:

the monitor includes a prism member formed on at least a lower part of the ink cartridge; and the monitor judges the ink-end state based on a difference between a first critical angle of total reflection defined by refractive indices of the ink in the ink cartridge and a material of the prism member, and a second critical angle of total reflection defined by refractive indices of the material of the prism member and atmosphere.

16. The ink jet recording apparatus as set forth in claim 15, wherein:

the monitor includes at least one pair of a light source which emits a light beam toward the prism member and a photo sensor which detects the light beam reflected by the prism member; and the monitor judges the ink-end state when the photo sensor detects the light beam reflected by the prism member.

17. The ink jet recording apparatus as set forth in claim 1, wherein:

the monitor includes at least one pair of electrode terminals provided in at least a lower portion of the ink cartridge while extending inside of the ink cartridge and a detection circuit which detects a resistance between the electrode terminals; and the monitor judges the ink-end state when the detection circuit detects a drop of the resistance.

18. The ink jet recording apparatus as set forth in claim 1, further comprising:

a subtank, which stores ink replenished from the ink cartridge and supplies the ink to the recording head;

a detector, which detects an ink amount contained in the subtank;

a second counter, which updates an ink amount consumed by the recording head based on the consumed ink amount calculated by the calculator, wherein the corrector corrects the calculation in the calculator based on the consumed ink amount indicated by the second counter, when the detector detects that the ink amount in the subtank is a predetermined amount or less.

19. A method of correcting calculation for an ink amount consumed in a recording head incorporated in an ink jet recording apparatus, comprising the steps of:

providing an ink tank which supplies ink to the recording head;

providing a counter which indicates a residual ink amount in the ink tank;

calculating an ink amount consumed by the recording head;

updating the residual ink amount indicated by the counter, based on the calculated consumed ink amount;

providing a monitor which monitors a residual ink amount in the ink tank independently from the counter; and correcting the way of calculation, based on a difference between the residual ink amount monitored by the monitor and the updated residual ink amount of the counter, when the monitored residual ink amount is a predetermined amount or less.

20. The correction method as set forth in claim 19, wherein:

the calculation is performed by multiplying a coefficient by the number of ink drops ejected from the recording head at least when a printing operation is performed and when a flushing operation is performed; and the coefficient is corrected in the correcting step.

21. An ink jet recording apparatus, comprising:

a recording head, from which ink drops are ejected;

a cartridge holder, on which an ink cartridge for supplying ink to the recording head is detachably mounted;

a subtank, which stores ink replenished from the ink cartridge and supplies the ink to the recording head;

a detector, which detects an ink amount contained in the subtank;

a calculator, which performs calculation of an ink amount consumed by the recording head;

a counter, which updates a consumed ink amount based on the consumed ink amount calculated by the calculator; and a corrector, which corrects the calculation in the calculator after ink is newly replenished from the ink cartridge to the subtank, based on a difference between the ink amount contained in the subtank detected by the detector and the consumed ink amount indicated by the counter, when the detector detects that the ink amount in the subtank is a predetermined amount or less.

* * * * *